US010451377B1

(12) United States Patent
Shieh

(10) Patent No.: US 10,451,377 B1
(45) Date of Patent: Oct. 22, 2019

(54) AUXILIARY CATAPULT DEVICE OF GRENADE

(71) Applicant: Ming-Long Shieh, Yunlin County (TW)

(72) Inventor: Ming-Long Shieh, Yunlin County (TW)

( * ) Notice: Subject to any disclaimer, the term of this patent is extended or adjusted under 35 U.S.C. 154(b) by 0 days.

(21) Appl. No.: 16/210,201

(22) Filed: Dec. 5, 2018

(51) Int. Cl.
*F41B 7/00* (2006.01)
*F42B 27/00* (2006.01)
*F42B 6/00* (2006.01)

(52) U.S. Cl.
CPC ..... *F41B 7/003* (2013.01); *F42B 6/00* (2013.01); *F42B 27/00* (2013.01)

(58) Field of Classification Search
CPC .... F41B 7/00; F41B 7/003; F42B 6/00; F42B 27/00
USPC ..... 124/16, 26, 27
See application file for complete search history.

(56) References Cited

U.S. PATENT DOCUMENTS 159,003 A * 1/1875 Wiedemann et al. .. F41B 3/005 124/21
706,399 A * 8/1902 Fifer ..... F41B 7/006 124/29
1,151,663 A * 8/1915 Carter ..... F41B 7/006 124/29
1,270,293 A * 6/1918 Hoexter et al. ..... F41B 7/006 124/29
1,274,882 A * 8/1918 Hess ..... F41B 7/006 124/29
1,278,514 A * 9/1918 Snyder et al. ..... F41B 3/005 124/21
1,486,807 A * 3/1924 Skala ..... F41B 7/02 124/18
2,287,636 A * 6/1942 Hayter ..... F41B 3/005 124/21
2,523,805 A * 9/1950 Anthony ..... A63B 69/407 124/16
3,191,342 A * 6/1965 Chalmers ..... A63H 27/14 124/16
3,261,342 A * 7/1966 Harper ..... F41B 7/00 124/29
3,572,311 A * 3/1971 Baer ..... F41B 3/02 124/20.1
3,919,799 A * 11/1975 Austin, Jr. ..... F41C 27/06 42/105
4,036,203 A * 7/1977 Chapman ..... F41B 7/08 124/21

(Continued)

*Primary Examiner* — Alexander R Niconovich
(74) *Attorney, Agent, or Firm* — Alan D. Kamrath; Mayer & Williams PC

(57) ABSTRACT

An auxiliary catapult device of a grenade contains: a throwing tube, a launch unit, and a trigger unit. The throwing tube includes an outlet, a shoulder, a throwing object, two slots, a through orifice, and a first connection portion, wherein the throwing object has a safety lever. The launch unit includes a piston, a first spring, a piston rod, and a pull bar, wherein the piston has a passing orifice, and the piston rod has a receiving orifice and an engagement portion. The trigger unit includes a seat, a button, two retainers, and two second springs, wherein the seat has an accommodating space, an opening, and a second connection portion. The second connection portion of the seat is connected with the first connection portion of the throwing tube. The button has a notch, and each retainer has a hook and a tilted contact portion.

10 Claims, 12 Drawing Sheets

(56) References Cited

U.S. PATENT DOCUMENTS

| | | | | | |
|---|---|---|---|---|---|
| 4,279,169 | A * | 7/1981 | Hancovsky | A63B 69/407 | 124/31 |
| 5,052,144 | A * | 10/1991 | Ostor | F41A 9/25 | 42/105 |
| 5,579,749 | A * | 12/1996 | Wilkinson | F41B 3/005 | 124/16 |
| 5,690,089 | A * | 11/1997 | Ward | F41B 7/00 | 124/16 |
| 6,112,733 | A * | 9/2000 | Wooten | F41B 13/00 | 124/16 |
| 7,448,371 | B2 * | 11/2008 | Sapir | F41B 3/005 | 124/16 |
| 7,905,222 | B1 * | 3/2011 | Fenley | A63B 69/407 | 124/16 |
| 8,371,280 | B2 * | 2/2013 | Vanek | A63H 33/18 | 124/16 |
| 9,970,732 | B2 * | 5/2018 | Mellen | F41B 7/08 | |
| 2003/0143922 | A1 * | 7/2003 | Du | A63H 37/00 | 446/475 |
| 2005/0188977 | A1 * | 9/2005 | Wygant | A63B 69/409 | 124/73 |
| 2007/0298647 | A1 * | 12/2007 | Lee | A63F 9/0204 | 439/354 |
| 2010/0313742 | A1 * | 12/2010 | Silva | F41A 1/04 | 89/7 |
| 2016/0016095 | A1 * | 1/2016 | Aguila | A63H 37/00 | 124/16 |

* cited by examiner

AUXILIARY CATAPULT DEVICE OF GRENADE

BACKGROUND OF THE INVENTION

Field of the Invention

The present invention relates to a throwing device, and more particularly to the throwing device which is applicable for a grenade, a baseball and lifesaving equipment.

Description of the Prior Art

A conventional throwing device is applicable for military usage or lifesaving field, the throwing device contains a pneumatic launcher, a throwing object is accommodated in a throwing tube, and a trigger is pulled so that gas is released to produce a pressure for throwing the throwing object onto to around a target in a long distance.

However, the pneumatic launcher is engaged with the throwing object matingly so that the gas is stored in the pneumatic launcher. When the pneumatic launcher is not engaged with the throwing object matingly, the gas cannot be stored in the pneumatic launcher, so the pneumatic launcher has to mate with the throwing object solely.

Another conventional throwing device contains a spring configured to shoot the throwing object, for example, the spring bounces after being pressed so as to push the throwing object out of the throwing tube. The spring produces elasticity fatigue after a period of using time, and it is necessary to replace the spring after a time-consuming disassembly of the throwing device.

When the throwing tube is adapted to shoot a grenade, a safety lever is removed from the grenade, and the grenade is put into the throwing tube so as to be shot. So, it is impossible to stop throwing and to remove the grenade from the throwing tube, when the user decides not to shoot the grenade.

The present invention has arisen to mitigate and/or obviate the afore-described disadvantages.

SUMMARY OF THE INVENTION

The primary objective of the present invention is to provide an auxiliary catapult device of a grenade in which a piston of a launch unit is engaged with two retainers of a trigger unit, the piston presses a first spring, and the first spring bounces and pushes the piston, such that a throwing object is shot by the piston in a long distance, thus obtaining military attach, training or life-saving purpose.

Further objective of the present invention is to provide an auxiliary catapult device of a grenade by which when the first spring is replaced after its elasticity fatigue, a pull bar is detached from two slots, a passing orifice and a receiving orifice, and the launch unit is removed from an outlet, thus replacing the first spring easily and quickly.

Another objective of the present invention is to provide an auxiliary catapult device of a grenade by which when a user decides not to launch the throwing object instantaneously, a safety lever is fixed on the throwing object via the through orifice after being removed, and the throwing tube is placed upside down to slide the throwing object out of the throwing tube quickly and safely.

To obtain above-mentioned objects, an auxiliary catapult device of a grenade provided by the present invention contains: a throwing tube, a launch unit, and a trigger unit.

The throwing tube is hollow and includes an outlet defined on a first end of the throwing tube, a shoulder formed on a second end of the throwing tube, a throwing object being fed into and shot out of the outlet. The throwing tube further includes two slots passing through the throwing tube and a through orifice, the throwing object includes a safety lever arranged on the throwing object and is accommodated in the throwing tube. The safety lever is pulled out of or fixed into the through orifice, and the throwing tube further includes a first connection portion located on an outer end of the shoulder.

The launch unit includes a piston, a first spring, a piston rod, and a pull bar. The piston has a passing orifice defined on a peripheral side of the piston and is received in the throwing tube. The first spring is fitted between the piston and the shoulder of the throwing tube, the piston rod has a receiving orifice defined on a first end of the piston rod, and the piston rod has an engagement portion formed on a second end of the piston rod. The pull bar extends out of the first and second ends of the throwing tube via the two slots, the passing orifice, and the receiving orifice.

The trigger unit includes a seat, a button, two retainers, and two second springs, wherein the seat has an accommodating space defined therein, an opening defined on a bottom of the accommodating space, and a second connection portion arranged on a distal end of the seat. The second connection portion of the seat is connected with the first connection portion of the throwing tube. The button has a notch, an inner diameter of which is less than an outer diameter of the notch. The button is accommodated in the opening and the notch of the button faces the accommodating space. Each of the two retainers has a hook formed on a first end thereof, a tilted contact portion formed on the second end of each retainer, wherein the two retainers are fixed in the accommodating space, and two hooks of the two retainers are opposite to each other and are retained with the engagement portion of the piston rod. The tilted contact portion contacts with the notch, two first ends of the two second springs abut against two recesses of the two retainers individually, and two second ends of the two second springs respectively contact with of the accommodating space.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
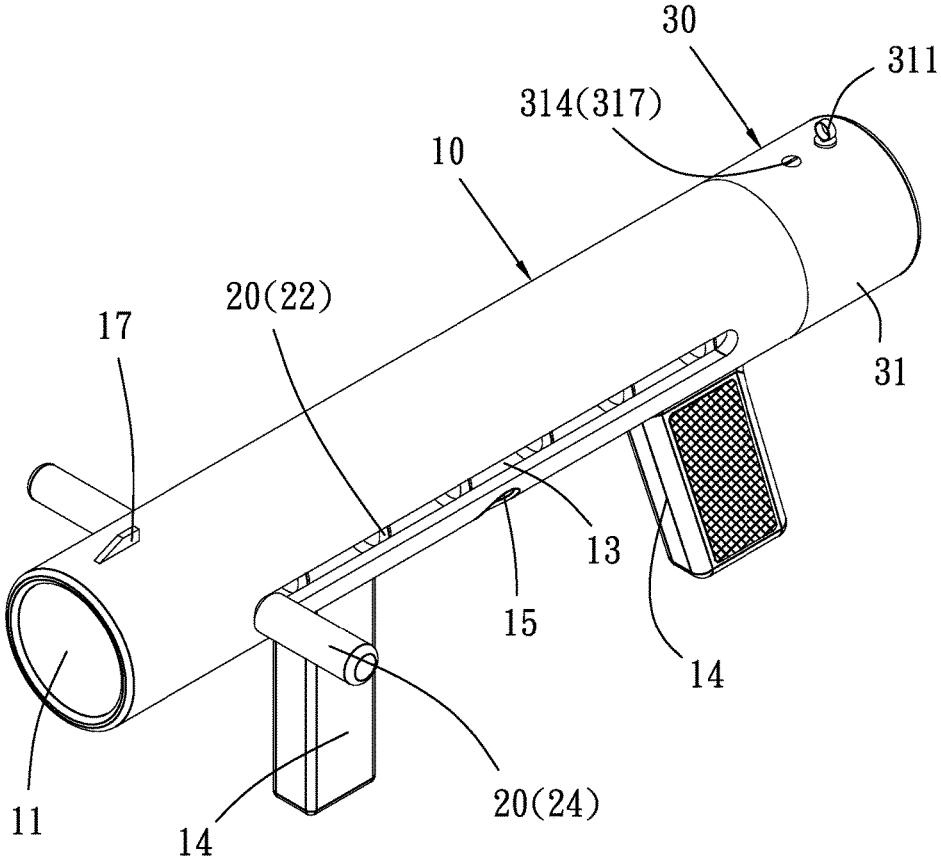
FIG. 1 is a perspective view showing the assembly of a throwing tube and a trigger unit of an auxiliary catapult device of a grenade according to a preferred embodiment of the present invention.
Figure 2:
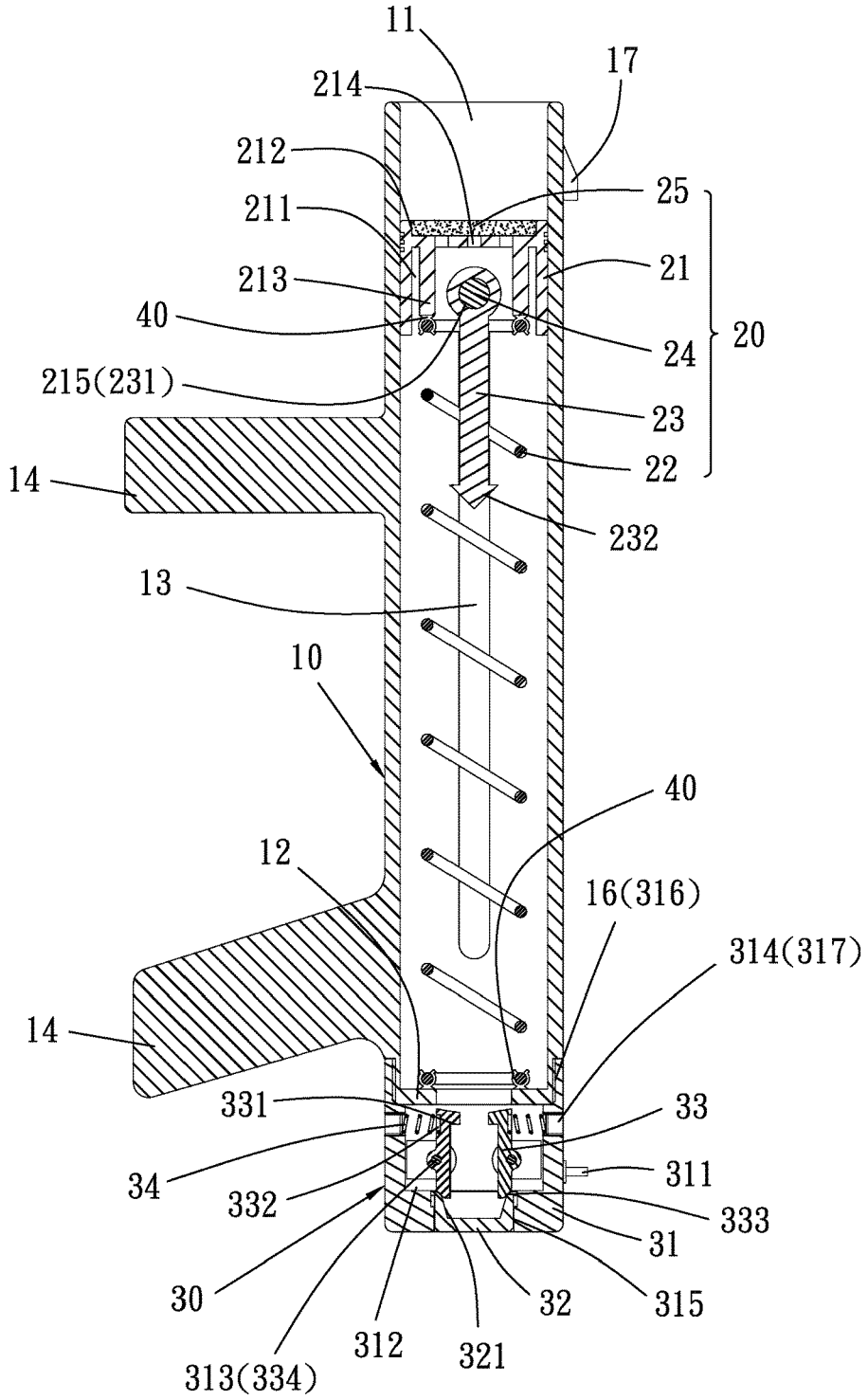
FIG. 2 is a cross sectional view showing the assembly of the throwing tube, a launch unit, the trigger unit, and multiple fasteners of the auxiliary catapult device of the grenade according to the preferred embodiment of the present invention.
Figure 6:
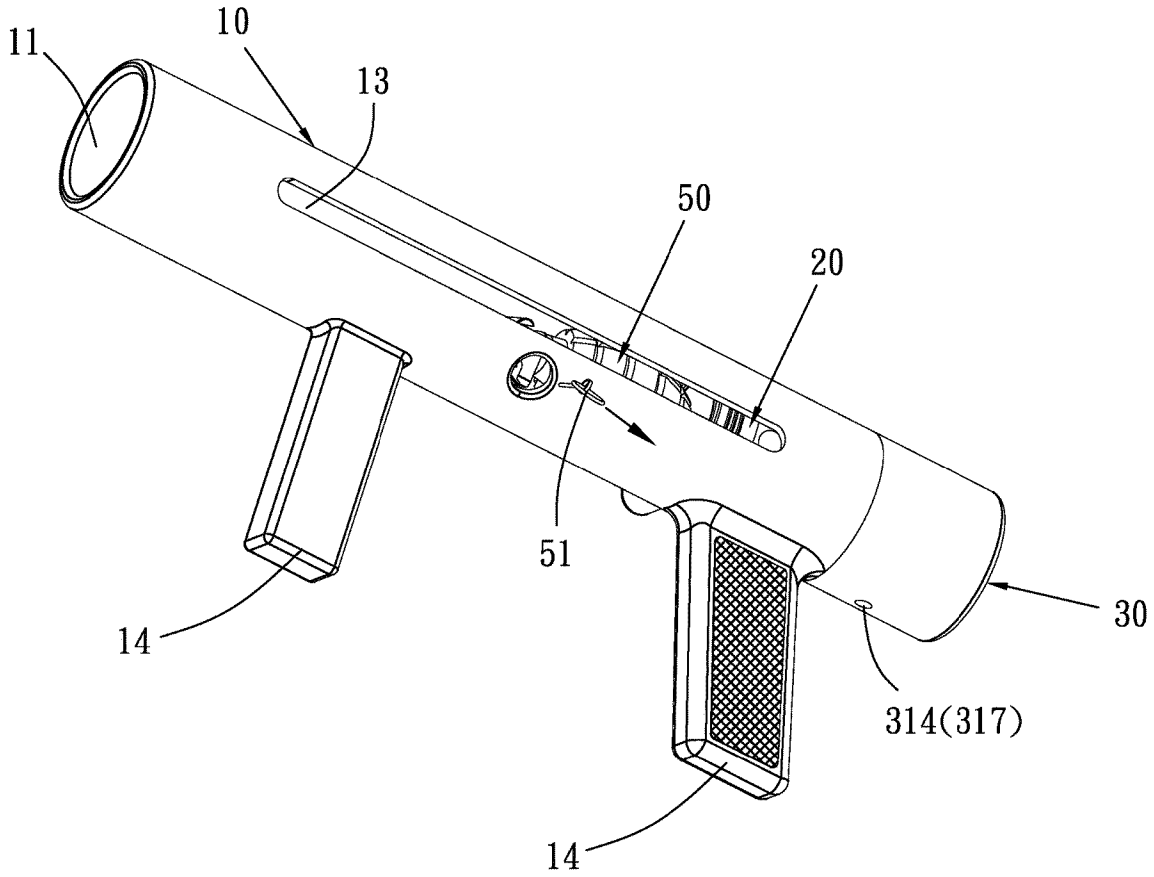
FIG. 6 is a perspective view showing the operation of the auxiliary catapult device of the grenade according to the preferred embodiment of the present invention.

With reference to FIGS. 1, 2, and 6, an auxiliary catapult device of a grenade according to a preferred embodiment of the present invention comprises: a throwing tube 10, a launch unit 20, a trigger unit 30, and multiple fasteners 40.

The throwing tube 10 is hollow and includes an outlet 11 defined on a first end of the throwing tube 10, a shoulder 12 formed on a second end of the throwing tube 10, wherein a throwing object 50 is fed into and shot out of the outlet 11. The throwing tube 10 further includes two slots 13 passing therethrough, two grip portions 14, and a through orifice 15, wherein the two grip portions 14 are grasped by a user's hands. The throwing object 50 includes a safety lever 51 arranged thereon, the throwing object 50 is accommodated in the throwing tube 10, and the safety lever 51 is pulled out of the through orifice 15, the throwing tube 10 further includes a first connection portion 16 located on an outer end of the shoulder 12, wherein the first connection portion 16 is outer threads. The throwing tube 10 includes a front sight 17 adjacent to the outlet 11 and configured to aim a target.

The launch unit 20 includes a piston 21, a first spring 22, a piston rod 23, a pull bar 24, and a cushion 25. The piston 21 has a first accommodation groove 211 defined on a first end thereof, a second accommodation groove 212 formed on a second end of the piston 21, a forced portion 213 formed in a hollow ring shape and received in the first accommodation groove 211, multiple air orifices 214 defined between the first accommodation groove 211 and the second accommodation groove 212, wherein the multiple air orifices 214 are configured to reduce air resistance as the piston 21 moves so that the throwing object 50 is shot far away. The piston 21 further has a passing orifice 215 defined on a peripheral side thereof, wherein the first accommodation groove 211 of the piston 21 faces the shoulder 12, and the second accommodation groove 212 faces the outlet 11 of the throwing tube 10. The first spring 22 is fitted between the piston 21 and the shoulder 12 of the throwing tube 10. The piston rod 23 has a receiving orifice 231 defined on a first end thereof and has an engagement portion 232 formed in an inverted triangle shape on a second end of the piston rod 23. The pull bar 24 extends out of the first and second ends of the throwing tube 10 via the two slots 13, the passing orifice 215, and the receiving orifice 231. The cushion 25 is accommodated in the second accommodation groove 212 so as to buffer the throwing object 50 received in the throwing tube 10. The launch unit 20 is movably received in the throwing tube 10, extends out of the two slots 13, and is stopped by the shoulder 12.

The trigger unit 30 includes a seat 31, a button 32, two retainers 33, and two second springs 34. The seat 31 has a rear sight 311 arranged on an outer surface thereof, an accommodating space 312 defined in the seat 31, two connection elements 313 arranged on an inner wall of the accommodating space 312, two opposite fixing portions 314, an opening 315 defined on a bottom of the accommodating space 312, and a second connection portion 316 arranged on a distal end of the seat 31, wherein the second connection portion 316 is inner threads, the rear sight 311 aligns with the front sight 17 linearly so that the user aligns with the front sight 17 by using the rear sight 311 and aims the target by ways of the front sight 17, thus throwing the throwing object 50 onto or close to the target. The two opposite fixing portions 314 are a threaded hole and are screwed with two screwing elements 317 respectively. The second connection portion 316 of the seat 31 is screwed with the first connection portion 16 of the throwing tube 10. The button 32 has a notch 321, an inner diameter of which is less than an outer diameter of the notch 321. The button 32 is accommodated in the opening 315 and its notch 321 faces the accommodating space 312. Each of the two retainers 33 has a hook 331 formed on a first end thereof, a recess 332 defined on a second end of each retainer 33 opposite to the hook 331, a tilted contact portion 333 formed on the second end of each retainer 34, and each of two apertures 334 defined between the hook 331 and the tilted contact portion 333. The two retainers 33 are fixed in the accommodating space 312 and are rotatably connected with the two connection elements 313 by ways of the two apertures 334 respectively, and two hooks 331 of the two retainers 33 are opposite to each other and are retained with the engagement portion 232 of the piston rod 23. The tilted contact portion 333 contacts with the notch 321, two first ends of the two second springs 34 abut against two recesses 332 of the two retainers 33 individually, and two second ends of the two second springs 34 respectively contact with the two opposite fixing portions 314 of the accommodating space 312. The two second springs 34 are removed from the two opposite fixing portions 314 individually by ways of the two screwing elements 317. The trigger unit 30 is connected with the first connection portion 16 of the throwing tube 10 and is engaged with the launch unit 20, wherein the trigger unit 30 drives the launch unit 20 to push the throwing object 50 out of the throwing tube 10.

The multiple fasteners 40 are in a C shape and are mounted on the shoulder 12 and the forced portion 213 oppositely, wherein the multiple fasteners 40 are secured on two ends of the first spring 22 respectively.

Figure 3:
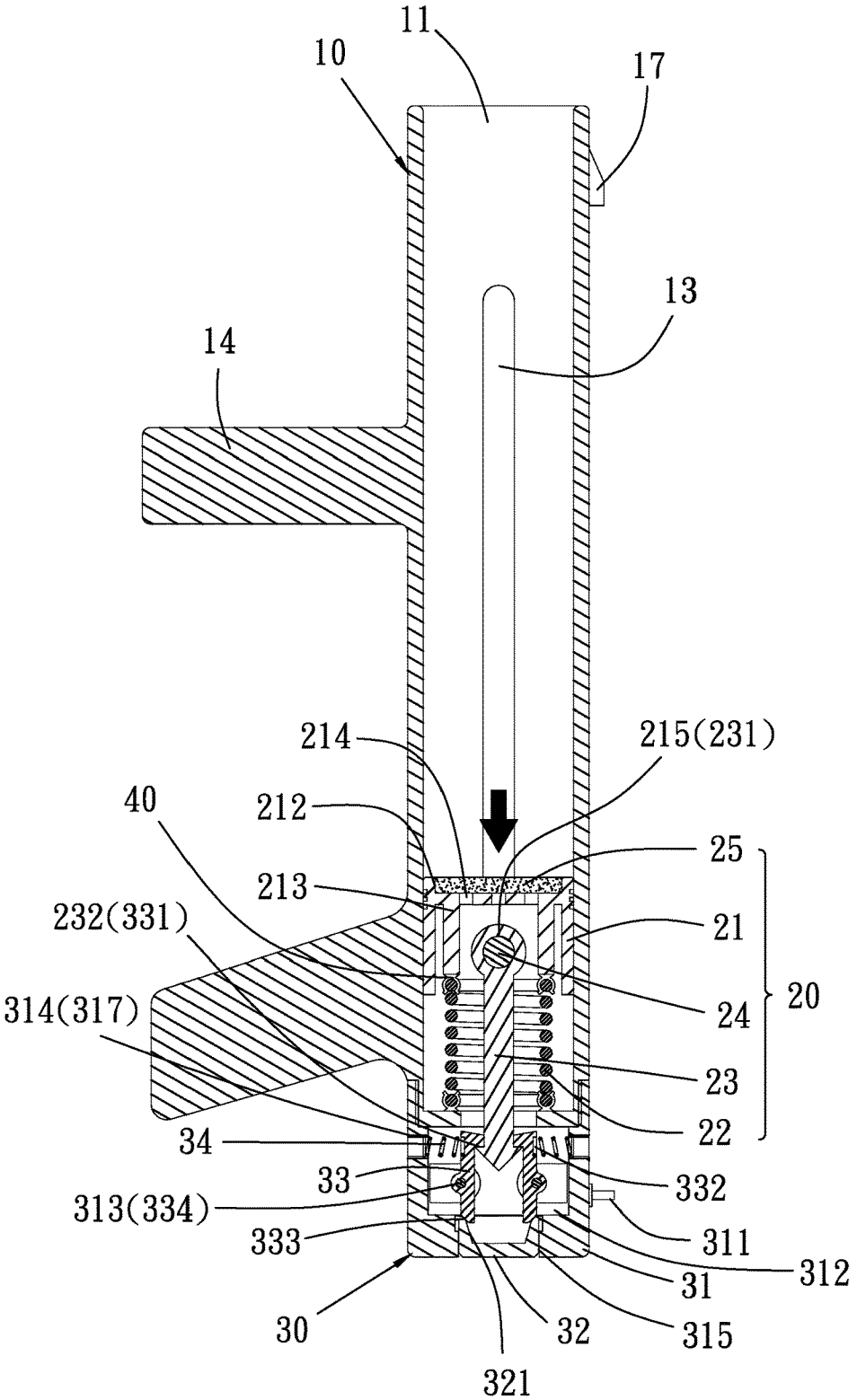
FIG. 3 is a cross sectional view showing the operation of the auxiliary catapult device of the grenade according to the preferred embodiment of the present invention.
Figure 4:
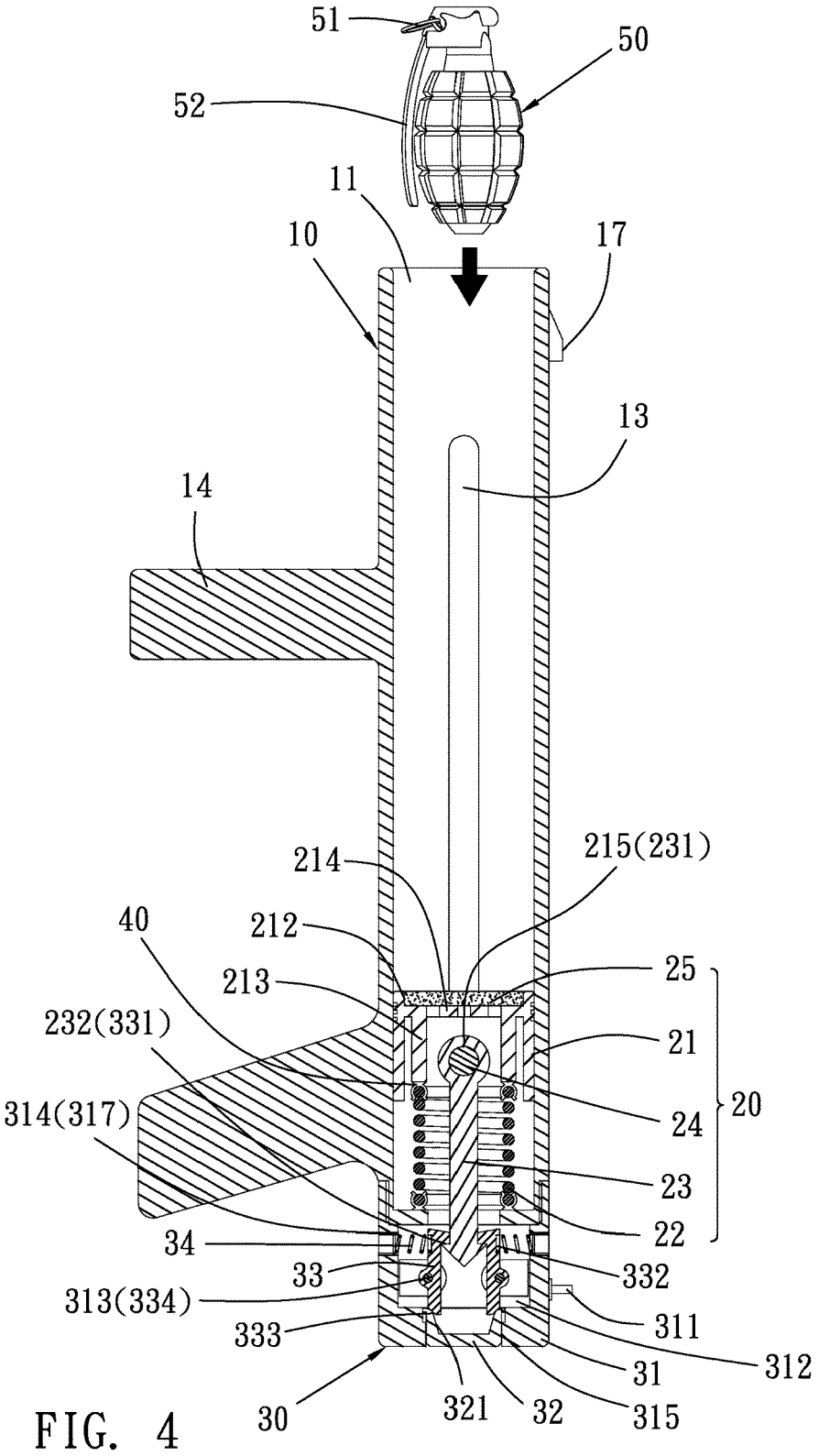
FIG. 4 is another cross sectional view showing the operation of the auxiliary catapult device of the grenade according 205 to the preferred embodiment of the present invention.
Figure 5:
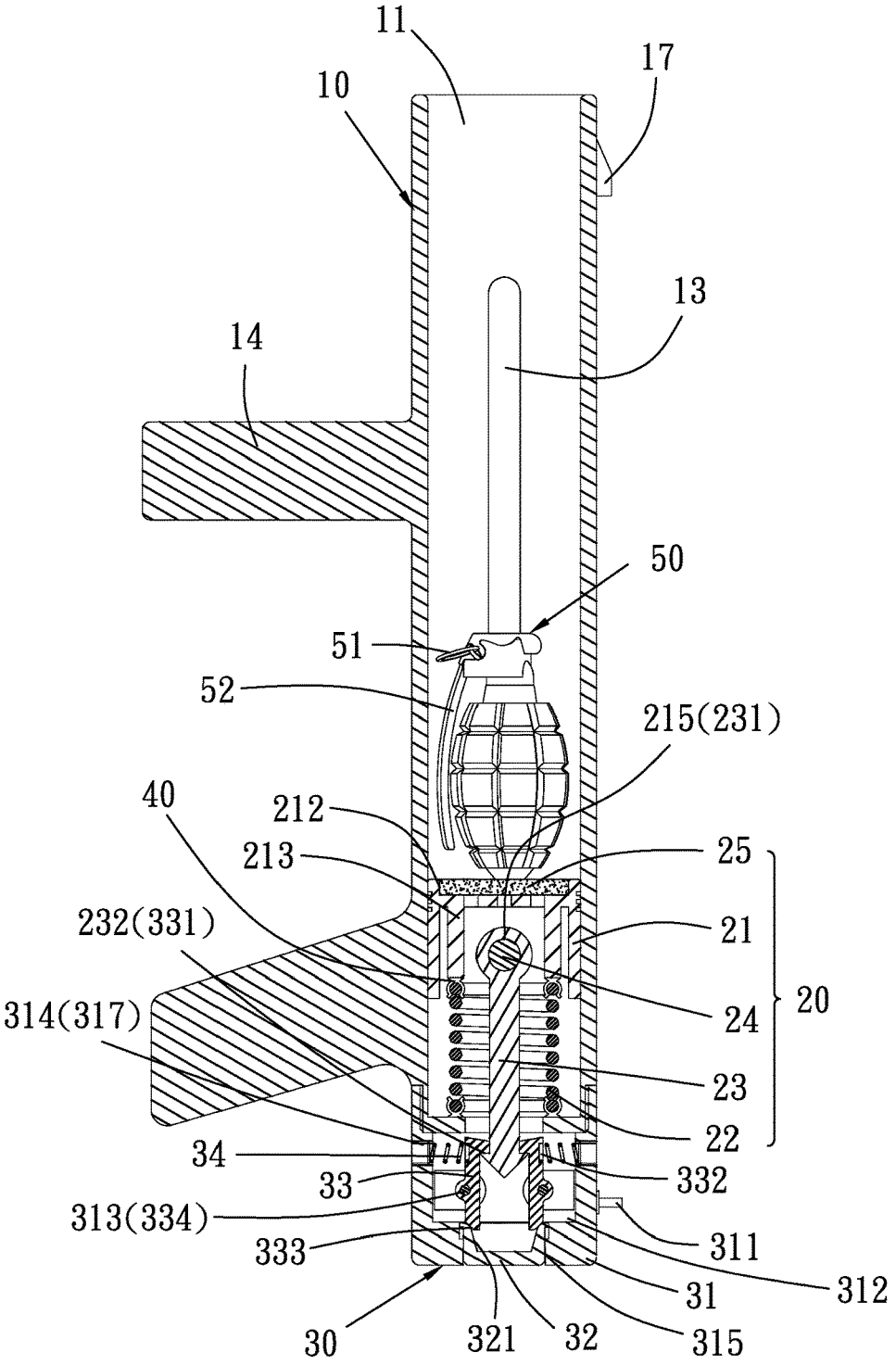
FIG. 5 is also another cross sectional view showing the operation of the auxiliary catapult device of the grenade according to the preferred embodiment of the present invention.
Figure 7:
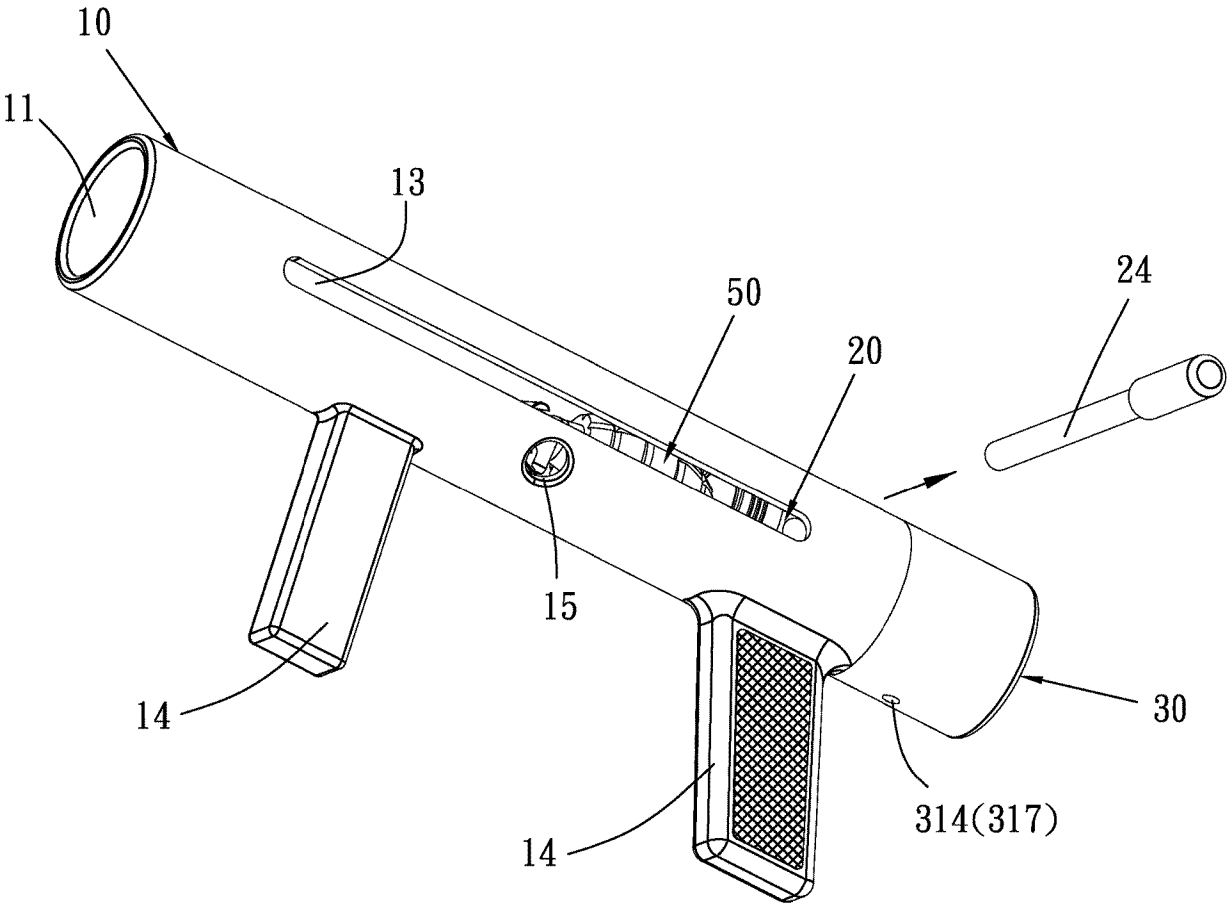
FIG. 7 is another perspective view showing the operation of the auxiliary catapult device of the grenade according to the preferred embodiment of the present invention.
Figure 8:
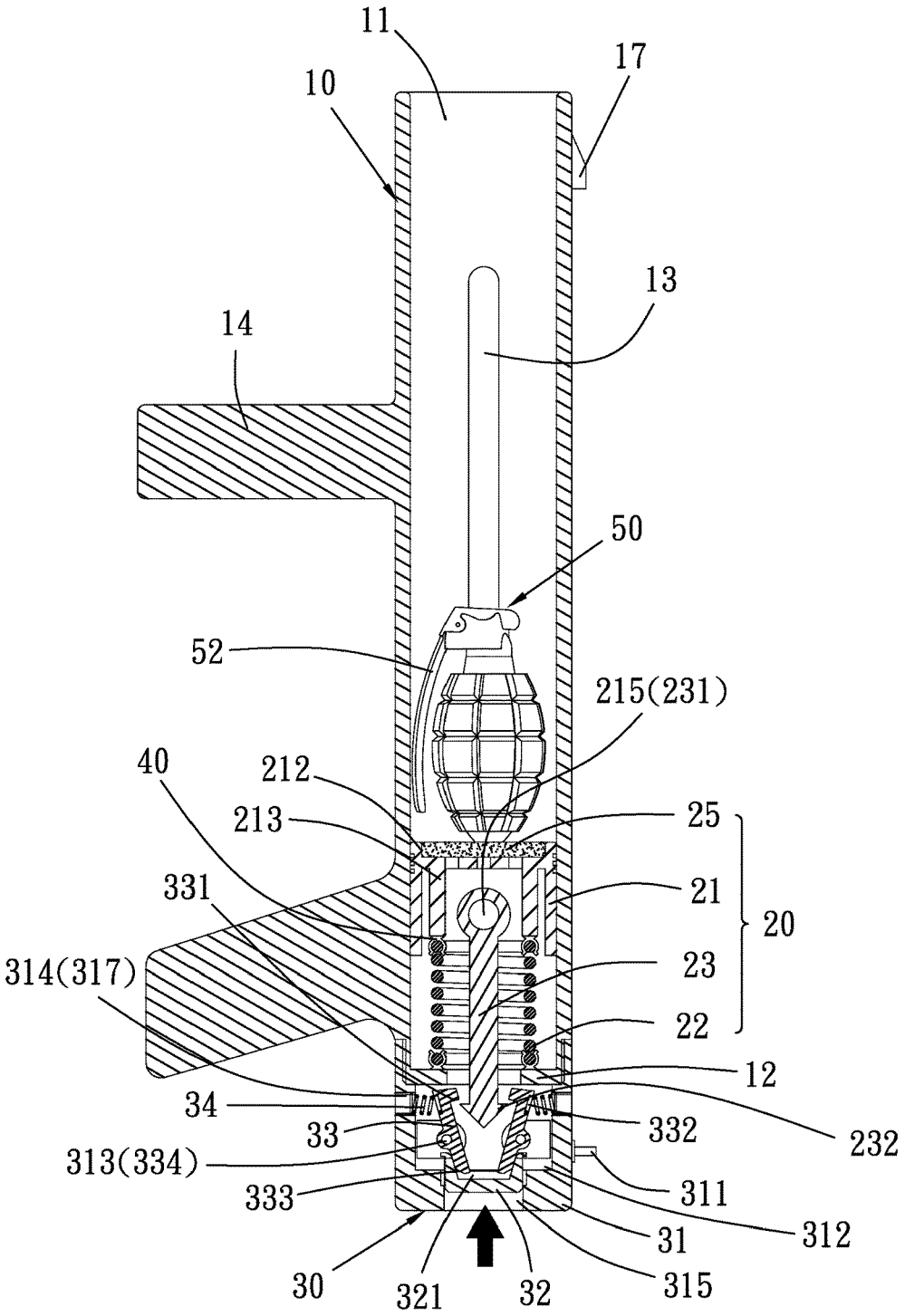
FIG. 8 is still another cross sectional view showing the operation of the auxiliary catapult device of the grenade according to the preferred embodiment of the present invention.
Figure 9:
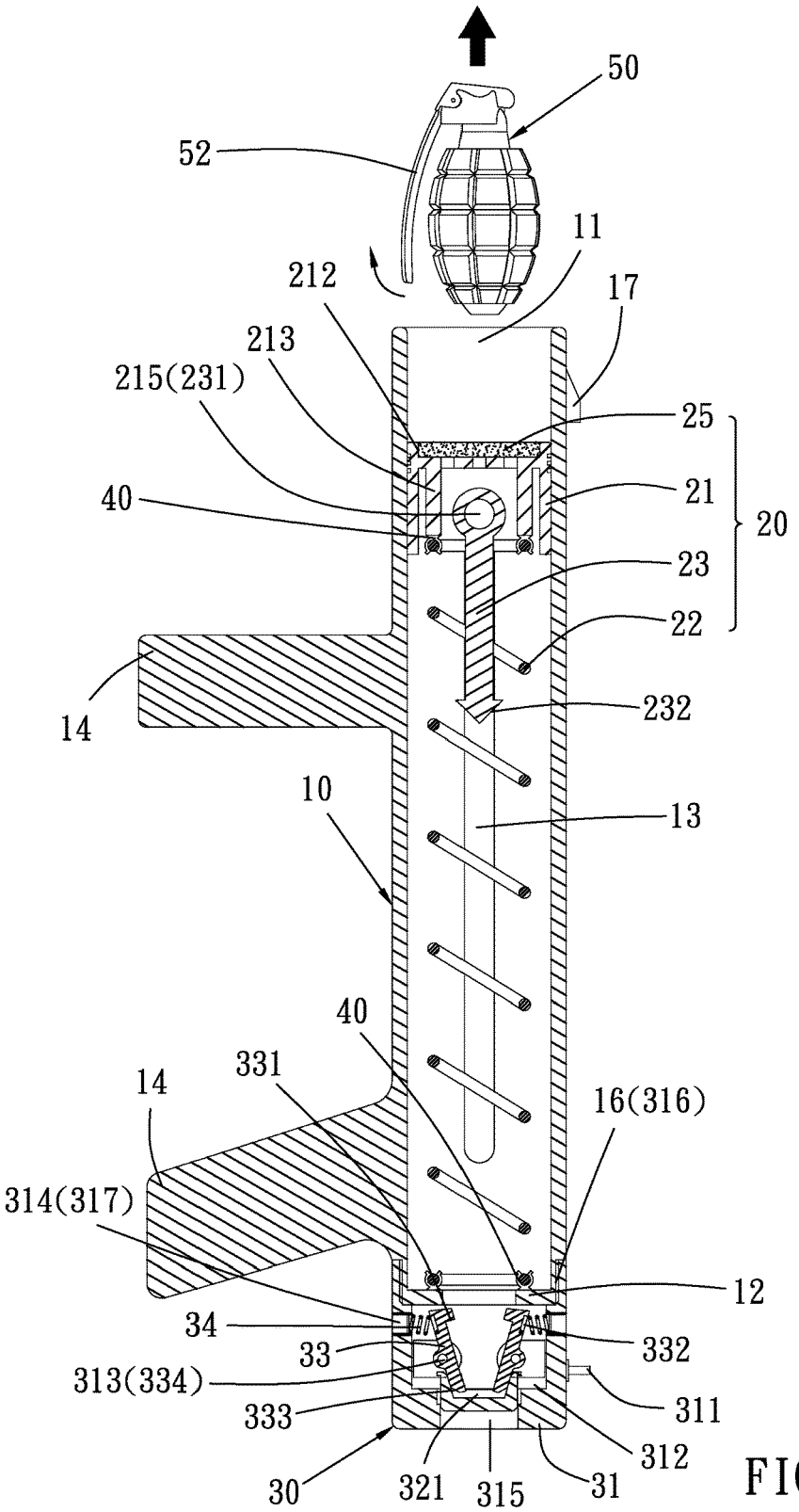
FIG. 9 is another cross sectional view showing the operation of the auxiliary catapult device of the grenade according to the preferred embodiment of the present invention.

As shown in FIG. 3, in operation, the pull bar 24 is pulled by the user so that the pull bar 24 moves close to the shoulder 12 along the two slots 13 of the throwing tube 10, the piston 12 is actuated by the pull bar 24 to move close to the shoulder 12, and the forced portion 213 and the shoulder 12 press the first spring 22. The engagement portion 232 of the piston rod 23 passes through the shoulder 12 and moves into the accommodating space 312 of the seat 31 of the trigger unit 30, wherein the engagement portion 232 push the two hooks 331 of the two retainers 33 which are rotatably connected with the two connection elements 313 respectively so that the two hooks 331 move reversely, and the engagement portion 232 moves between the two retainers 33 via the two hooks 331 individually. The two retainers 33 are biased by the two second springs 34 respectively so that the two hooks 331 move close to each other and retain with the engagement portion 232. As illustrated in FIGS. 4-5, the throwing object 50 is put into the throwing tube 10 from the outlet 11, wherein the throwing object 50 is any one of grenade, baseball and lifesaving equipment. The cushion 25 lessens impact so as to avoid a removal of the two hooks 331 from the engagement portion 232, when the throwing object 50 is put into the throwing tube 10, as shown in FIG. 6, the safety lever 51 of the throwing object 50 is removed via the through orifice 15, and when the user decides not to launch the throwing object 50 instantaneously, the safety lever 51 is fixed on the throwing object 50 via the through orifice 15, and the throwing tube 10 is placed upside down to slide the throwing object 50 out of the throwing tube 10. As shown in FIG. 7, the pull bar 24 is detached from the launch unit 20 and the throwing tube 10. As illustrated in FIGS. 8 and 9, the button 32 is pressed so that the tilted contact portion 333 removes from the notch 321 and moves close to each other, and the two hooks 331 moves reversely to remove from the engagement portion 232, hence the first spring 22 forces the forced portion 213 to push the piston 21, and the piston 21 moves to the outlet 11 quickly and throws the throwing object 50. The multiple fasteners 40 on the shoulder 12 pull the first spring 22, and the first spring 22 stops the multiple fasteners 40 of the forced portion 213 so that the piston 21 is not shot with the throwing object 50. The piston rod 23 of the launch unit 20 is engaged with the two retainers 33 of the trigger unit 30, and the first spring 22 is pressed to bounce the piston 21 so that the throwing object 50 is shot by the piston 21 forcefully in a long distance to obtain military attach, training or life-saving purpose.

Figure 10:
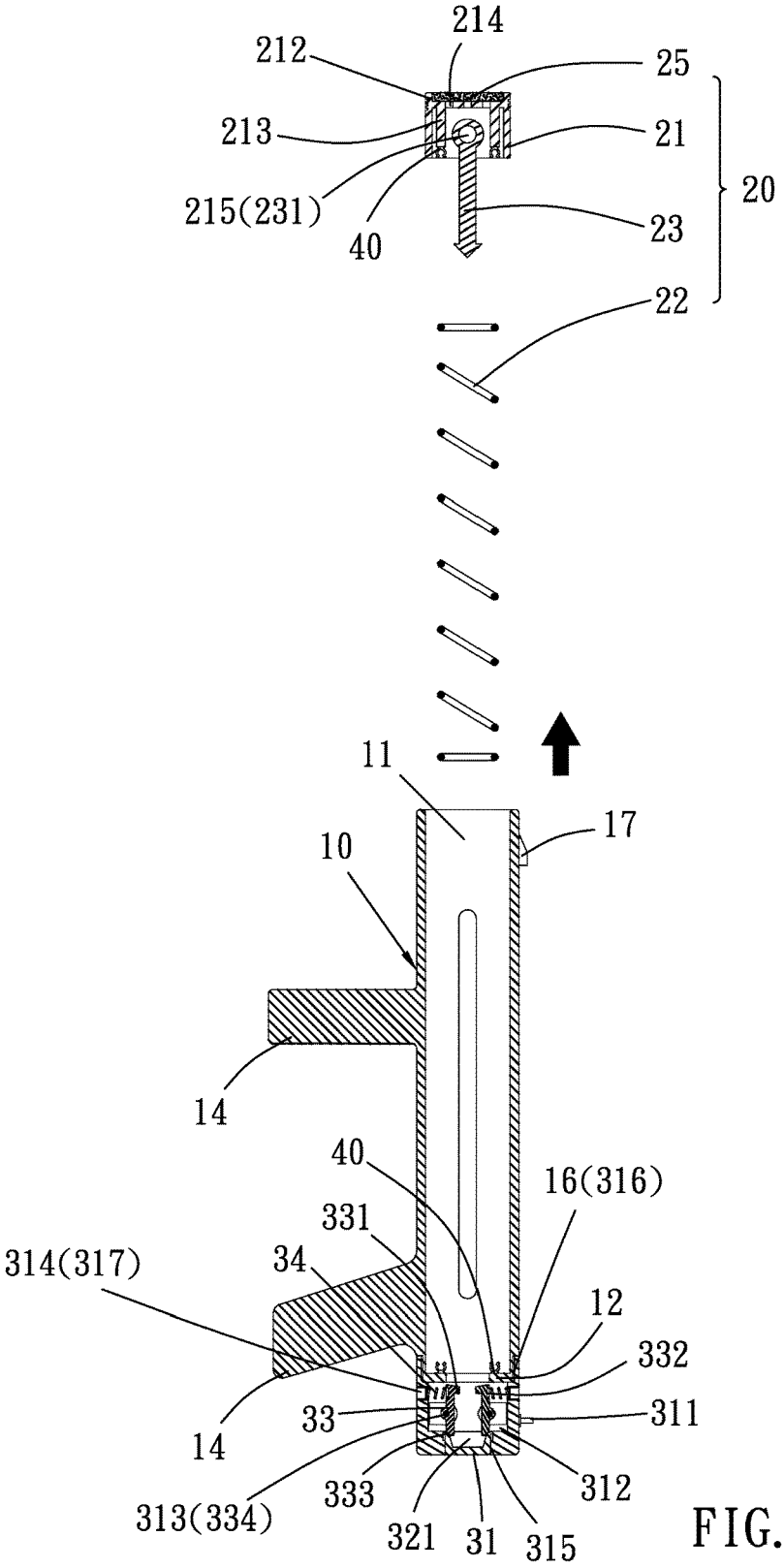
FIG. 10 is also another cross sectional view showing the operation of the auxiliary catapult device of the grenade according to the preferred embodiment of the present invention.

With reference to FIG. 10, when the first spring 22 is replaced after its elasticity fatigue, the pull bar 24 is detached from the two slots 13, the passing orifice 215, and the receiving orifice 231, thereafter the piston 21 is rotated so that the multiple fasteners 40 are removed from the first spring 22, and the launch unit 20 is detached from the outlet 11, thus replacing the first spring 22 easily and quickly.

As desiring to replace the trigger unit 30, the second connection portion 316 of the seat 31 is unscrewed with the first connection portion 16 of the throwing tube 10 so as to see and replace related components of the trigger unit 30. As desiring to replace the two second springs 34 of the trigger unit 30, the two screwing elements 317 are removed from the two opposite fixing portions 314 easily and quickly.

Figure 11:
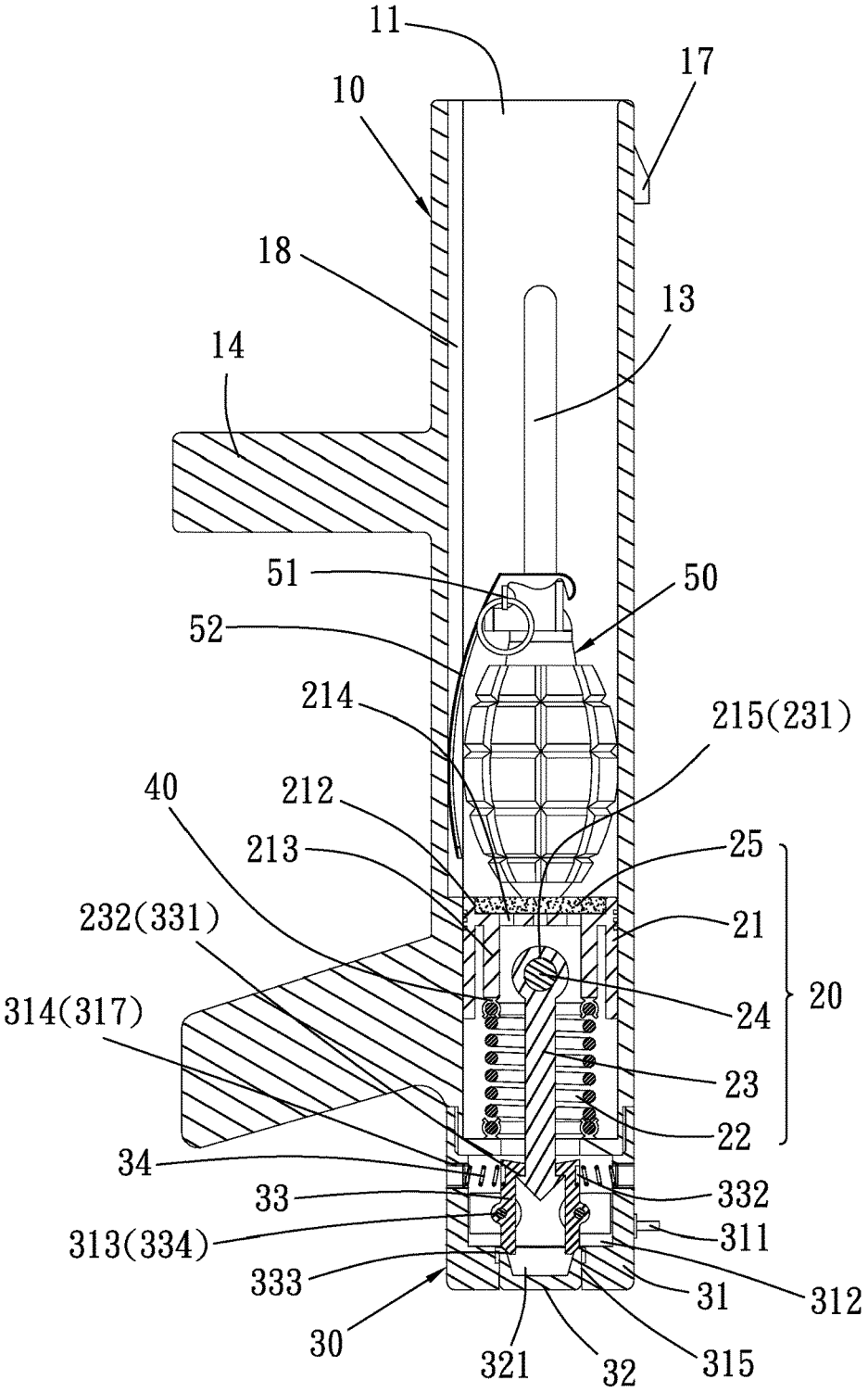
FIG. 11 is a cross sectional view showing the assembly of a throwing tube of an auxiliary catapult device of a grenade according to another preferred embodiment of the present invention.
Figure 12:
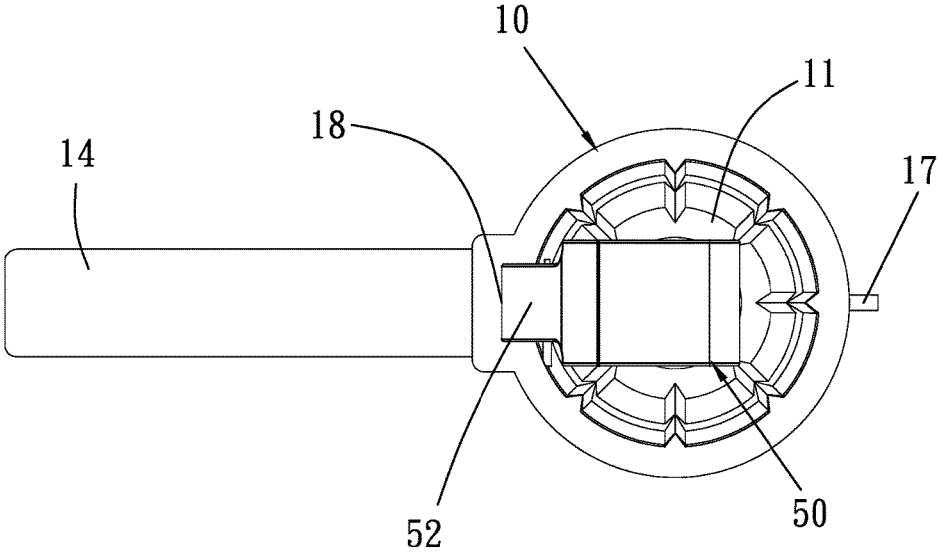
FIG. 12 is a side plan view showing the assembly of a locating rail and a locating rail of the auxiliary catapult device of a grenade according to another preferred embodiment of the present invention.

Referring to FIGS. 11 and 12, a difference of another embodiment from above-mentioned embodiment comprises: a locating rail 18 arranged on the throwing tube 10 and a handle 52 fixed on the throwing object 50, such that the handle 52 of the throwing object 50 is put along the locating rail 18 so that the throwing object 50 is located on the piston 21, and the safety lever 51 aligns with the through orifice 15.

Thereby, the auxiliary catapult device of the grenade has advantages as follows:

1. The piston 23 of the launch unit 20 is engaged with the two retainers 33 of the trigger unit 30, the piston 21 presses the first spring 22, and the first spring 22 bounces and pushes the piston 21, such that the throwing object 50 is shot by the piston 21 in the long distance, thus obtaining military, training or life-saving purpose.

2. When the first spring 22 is replaced after its elasticity fatigue, the pull bar 24 is detached from the two slots 13, the passing orifice 215 and the receiving orifice 231, and the launch unit 20 is removed from the outlet 11, thus replacing the first spring 22 easily and quickly.

3. When the user decides not to launch the throwing object 50 instantaneously, the safety lever 51 is fixed on the throwing object 50 via the through orifice 15 after being removed, and the throwing tube 10 is placed upside down to slide the throwing object 50 out of the throwing tube 10 quickly and safely.

While various embodiments in accordance with the present invention have been shown and described, it is clear to those skilled in the art that further embodiments may be made without departing from the scope of the present invention.

What is claimed is:

1. An auxiliary catapult device of a grenade comprising:

a throwing tube being hollow and including an outlet defined on a first end of the throwing tube, a shoulder formed on a second end of the throwing tube, a throwing object being fed into and shot out of the outlet, the throwing tube further including two slots passing through the throwing tube and a through orifice, the throwing object including a safety lever arranged on the throwing object, the throwing object being accommodated in the throwing tube, and the safety lever being pulled out of or fixed into the through orifice, the throwing tube further including a first connection portion located on an outer end of the shoulder;

a launch unit including a piston, a first spring, a piston rod, and a pull bar, the piston having a passing orifice defined on a peripheral side of the piston, and the piston being received in the throwing tube, the first spring being fitted between the piston and the shoulder of the throwing tube, the piston rod having a receiving orifice defined on a first end of the piston rod, and the piston rod having an engagement portion formed on a second end of the piston rod, wherein the pull bar extends out of the first and second ends of the throwing tube via the two slots, the passing orifice, and the receiving orifice; and a trigger unit including a seat, a button, two retainers, and two second springs, wherein the seat has an accommodating space defined therein, an opening defined on a bottom of the accommodating space, and a second connection portion arranged on a distal end of the seat, wherein the second connection portion of the seat is connected with the first connection portion of the throwing tube, the button has a notch, an inner diameter of which is less than an outer diameter of the notch, the button is accommodated in the opening and the notch of the button faces the accommodating space, each of the two retainers has a hook formed on a first end thereof, a tilted contact portion formed on the second end of each retainer, wherein the two retainers are fixed in the accommodating space, and two hooks of the two retainers are opposite to each other and are retained with the engagement portion of the piston rod, the tilted contact portion contacts with the notch, two first ends of the two second springs abut against two recesses of the two retainers individually, and two second ends of the two second springs respectively contact with of the accommodating space.

2. The auxiliary catapult device as claimed in claim 1, wherein the throwing tube further includes two grip portions which are grasped by a user's hands, and the throwing tube includes a front sight adjacent to the outlet and configured to aim a target; the seat has a rear sight arranged on an outer surface thereof, wherein the rear sight aligns with the front sight linearly so that the user aligns with the front sight by using the rear sight and aims the target by ways of the front sight, thus throwing the throwing object onto or close to the target.

3. The auxiliary catapult device as claimed in claim 1, wherein the launch unit is movably received in the throwing tube, extends out of the two slots, and is stopped by the shoulder.

4. The auxiliary catapult device as claimed in claim 3, wherein the trigger unit is engaged with the launch unit, and the trigger unit drives the launch unit to push the throwing object out of the throwing tube.

5. The auxiliary catapult device as claimed in claim 4, wherein the first connection portion is outer threads, the second connection portion is inner threads, and the second connection portion of the seat is screwed with the first connection portion of the throwing tube.

6. The auxiliary catapult device as claimed in claim 4, wherein the piston has a first accommodation groove defined on a first end thereof, a second accommodation groove formed on a second end of the piston, a forced portion formed in a hollow ring shape and received in the first accommodation groove, and multiple air orifices defined between the first accommodation groove and the second accommodation groove, the first accommodation groove of the piston faces the shoulder, and the second accommodation groove faces the outlet of the throwing tube, wherein the multiple air orifices are configured to reduce air resistance as the piston moves so that the throwing object is shot far away.

7. The auxiliary catapult device as claimed in claim 6, wherein the launch unit includes a cushion and multiple fasteners, the cushion is accommodated in the second accommodation groove so as to buffer the throwing object received in the throwing tube, and the multiple fasteners are in a C shape and are mounted on the shoulder and the forced portion oppositely, wherein the multiple fasteners are secured on two ends of the first spring respectively.

8. The auxiliary catapult device as claimed in claim 1, wherein the engagement portion is formed in an inverted triangle shape.

9. The auxiliary catapult device as claimed in claim 1, wherein the seat has two connection elements arranged on an inner wall of the accommodating space and two opposite fixing portions, the two opposite fixing portions are a threaded hole and are screwed with two screwing elements respectively, each retainer has a recess defined on a second end thereof opposite to the hook, wherein two first ends of the two second springs abut against two recesses of the two retainers individually, and two second ends of the two second springs respectively contact with the two opposite fixing portions of the accommodating space, after the two screwing elements are removed from the two opposite fixing portions, the two second springs are removed from the two opposite fixing portions respectively so as to be replaced.

10. The auxiliary catapult device as claimed in claim 1, wherein a locating rail is arranged on the throwing tube, and a handle is fixed on the throwing object, such that the handle of the throwing object is put along the locating rail so that the throwing object is located on the piston, and the safety lever aligns with the through orifice.

* * * * *